US009799260B2

(12) United States Patent
Song et al.

(10) Patent No.: US 9,799,260 B2
(45) Date of Patent: Oct. 24, 2017

(54) DISPLAY DEVICE WITH IMPROVED DISPLAY QUALITY

(71) Applicant: Samsung Display Co., Ltd., Yongin, Gyeonggi-do (KR)

(72) Inventors: Jae-Woo Song, Yongin (KR); Seung-Ho Park, Yongin (KR); Kang-Hee Lee, Yongin (KR); Mi-Young Joo, Yongin (KR); Jae-Hoon Lee, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 218 days.

(21) Appl. No.: 14/729,320

(22) Filed: Jun. 3, 2015

(65) Prior Publication Data

US 2016/0225305 A1 Aug. 4, 2016

(30) Foreign Application Priority Data

Jan. 30, 2015 (KR) ..... 10-2015-0014820

(51) Int. Cl.
*G09G 3/20* (2006.01)
*G09G 3/00* (2006.01)

(52) U.S. Cl.
CPC ..... *G09G 3/2092* (2013.01); *G09G 3/2022* (2013.01); *G09G 3/2055* (2013.01); *G09G 3/003* (2013.01); *G09G 2320/0223* (2013.01); *G09G 2320/0266* (2013.01)

(58) Field of Classification Search
CPC .. G09G 3/2092; G09G 3/2055; G09G 3/2022; G09G 3/003; G09G 2320/0223; G09G 2320/0266
See application file for complete search history.

(56) References Cited

U.S. PATENT DOCUMENTS

2003/0156128 A1* 8/2003 Ito ..... G09G 3/3648 345/690
2009/0289883 A1* 11/2009 Choi ..... G09G 3/2044 345/89
2011/0249041 A1* 10/2011 Otsuki ..... G09G 3/344 345/690
2013/0257897 A1* 10/2013 Kim ..... G09G 3/2025 345/596

(Continued)

FOREIGN PATENT DOCUMENTS

KR 10-0648601 11/2006
KR 10-2007-0053891 5/2007

(Continued)

*Primary Examiner* — Temesghen Ghebretinsae
*Assistant Examiner* — Ivelisse Martinez Quiles
(74) *Attorney, Agent, or Firm* — Knobbe Martens Olson & Bear LLP

(57) ABSTRACT

A display device includes a display panel, a dither table memory device, a dithering processor, and a display panel driver. The display panel includes a plurality of pixels. Dither tables are stored in the dither table memory device. The dithering processor selects a target dither table corresponding to a grayscale level of input data from among the plurality of dither tables and performs a dithering operation on the input data using the target dither table to generate dither data. The display panel driver drives the display panel based on the generated dither data.

13 Claims, 8 Drawing Sheets

(56) References Cited

U.S. PATENT DOCUMENTS

| | | | | |
|---|---|---|---|---|
| 2014/0292823 | A1* | 10/2014 | Lee | G09G 3/3225<br>345/690 |
| 2015/0287355 | A1* | 10/2015 | Cho | G09G 3/2074<br>345/691 |

FOREIGN PATENT DOCUMENTS

| | | |
|---|---|---|
| KR | 10-2013-0109815 | 10/2013 |
| KR | 10-2013-0131668 | 12/2013 |

* cited by examiner

FIG. 3

| | | | | | |
|---|---|---|---|---|---|
| 10GRAY | 0 | 0 | 0 | 0 | 1 |
| 30GRAY | 0 | 0 | 0 | 1 | 0 |
| 40GRAY | 0 | 0 | 0 | 1 | 1 |
| ⋮ | | | | | |
| 255GRAY | 1 | 1 | 1 | 1 | 1 |

DISPLAY DEVICE WITH IMPROVED DISPLAY QUALITY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application claims priority under 35 U.S.C. §119 to Korean patent Application No. 10-2015-0014820 filed on Jan. 30, 2015, the disclosure of which is hereby incorporated by reference herein in its entirety.

BACKGROUND

Field

Example embodiments relate to display devices capable of improving a display quality.

Description of the Related Technology

Flat panel display (FPD) devices are widely used as a display device of electronic devices because the FPD devices are relatively lightweight and thin compared to cathode-ray tube (CRT) display devices. Some examples of FPD devices are liquid crystal display (LCD) devices, plasma display panel (PDP) devices, and organic light emitting display (OLED) devices.

Generally, the display device includes a display panel and a display panel driver. The display device processes input image data by a variety of methods to improve the display quality. For example, the display device performs a dithering operation (or adding white noise to reduce distortion) to represent additional grayscales using limited grayscales. Therefore, the display device can improve the display quality by performing the dithering operation. However, a stripe pattern can occur on the display device owing to a resistor-capacitor (RC) delay.

SUMMARY OF CERTAIN INVENTIVE ASPECTS

Example embodiments provide a display device capable of improving the display quality.

According to some example embodiments, a display device may include a display panel including a plurality of pixels, a dither table memory device in which a plurality of dither tables are stored, a dithering processor configured to select a target dither table corresponding to a grayscale level of input data from among the plurality of dither tables, and to perform a dithering operation on the input data using the target dither table to generate dither data, and a display panel driver configured to drive the display panel based on the generated dither data.

In example embodiments, each of the dither tables may include a plurality of dither patterns. Each of the dither patterns may be formed by patterning a plurality of sub-grayscale values to represent a dither grayscale value.

In example embodiments, the dither tables may include a normal dither table and an altered dither table. The altered dither table may exclude at least one of the sub-grayscale values included in the normal dither table.

In example embodiments, the dithering processor may include a grayscale region determining part configured to determine an input data grayscale region corresponding to the grayscale level of the input data among a plurality of grayscale regions, the grayscale regions divided on the basis of at least threshold grayscale level, a dither table selecting part configured to select the target dither table corresponding to the input data grayscale region from among the plurality of dither tables, and a dither data generating part configured to generate the dither data by performing the dithering operation on the input data using the target dither table.

In example embodiments, the grayscale regions may include a first grayscale region, a second grayscale region, and a third grayscale region. The first grayscale region and the second grayscale region may be divided on the basis of a first threshold grayscale level. The second grayscale region and the third grayscale region may be divided on the basis of a second threshold grayscale level. The second threshold grayscale level may be higher than the first threshold grayscale level.

In example embodiments, the dither table selecting part may select the normal dither table as the target dither table when the input data grayscale region is included in the first grayscale region or the third grayscale region.

In example embodiments, the dither table selecting part may select the altered dither table as the target dither table when the input data grayscale region is included in the second grayscale region.

In example embodiments, the dithering processor further may include a delay region determining part configured to determine a delay region in which a RC delay occurs and a non-delay region in which the RC delay does not occur, based on a position of the input data on the display panel.

In example embodiments, the dither table selecting part may select the normal dither table as the target dither table when the input data corresponds to the non-delay region.

In example embodiments, the display panel driver may drive the display panel by a digital driving technique that represents a grayscale using a plurality of sub-fields for which time weights are different from each other.

In example embodiments, the altered dither table may exclude a minimum sub-grayscale value corresponding to a minimum sub-field of which time weight is smallest among the time weights of the sub-fields.

In example embodiments, the time weights of the sub-fields may be adjusted based on a distribution of the input data.

In example embodiments, the threshold grayscale levels may be adjusted based on the time weights of the sub-fields.

According to some example embodiments, a display device may include a display panel including a plurality of pixels, a dither table memory device in which a plurality of dither tables are stored, a dithering processor configured to select a target dither table corresponding to a position of input data on the display panel from among the plurality of dither tables, and to perform a dithering operation on the input data using the target dither table to generate dither data, and a display panel driver configured to drive the display panel based on the generated dither data.

In example embodiments each of the dither tables may include a plurality of dither patterns. Each of the dither patterns may be formed by patterning a plurality of sub-grayscale values to represent a dither grayscale value.

In example embodiments the dither tables may include a normal dither table and an altered dither table. The altered dither table may exclude at least one of the sub-grayscale values included in the normal dither table.

In example embodiments the dithering processor may include a delay region determining part configured to determine a delay region in which a RC delay occurs and a non-delay region in which the RC delay does not occur, based on a position of the input data on the display panel, a dither table selecting part configured to select the normal dither table as the target dither table when the input data corresponds to the non-delay region, and to select the altered dither table as the target dither table when the input data corresponds to the delay region, and a dither data generating part configured to generate the dither data by performing the dithering operation on the input data using the target dither table.

In example embodiments the display panel driver may drive the display panel by a digital driving technique that represents a grayscale using a plurality of sub-fields for which time weights are different from each other.

In example embodiments the altered dither table may exclude a minimum sub-grayscale value corresponding to a minimum sub-field of which time weight is smallest among the time weights of the sub-fields.

In example embodiments, the time weights of the sub-fields may be adjusted based on a distribution of the input data.

A display device according to example embodiments performs a dithering operation using a normal dither table and an altered dither table. The altered dither table excludes at least one selected from the sub-grayscale values included in the normal dither table. Thus, the altered dither table excludes the sub-grayscale values corresponding to a sub-field in which the display quality is degraded by the RC delay, and the like. Therefore, the display device alleviates or removes a stripe pattern by a RC delay and improves a display quality.

In addition, the display device performs the dithering operation using the altered dither table in a part of the grayscale regions or in a portion of the display panel, thereby reducing a dither noise.

BRIEF DESCRIPTION OF THE DRAWINGS

Exemplary embodiments will be described more fully hereinafter with reference to the accompanying drawings, in which various embodiments are shown.

FIG. 3 is a diagram illustrating an example of sub-grayscale values and sub-fields for representing dither grayscale values.

DETAILED DESCRIPTION OF CERTAIN INVENTIVE EMBODIMENTS

Exemplary embodiments will be described more fully hereinafter with reference to the accompanying drawings, in which various embodiments are shown.

Figure 1:
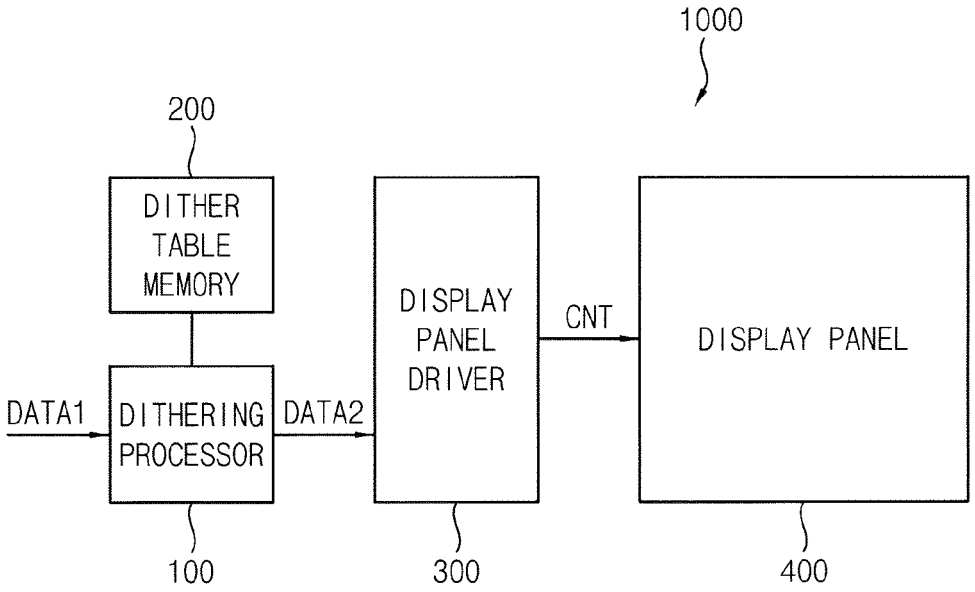
FIG. 1 is a block diagram illustrating a display device according to example embodiments.

FIG. 1 is a block diagram illustrating a display device according to example embodiments.

Referring to FIG. 1, the display device 1000 may include a dithering processor 100, a dither table memory device 200, a display panel driver 300, and a display panel 400.

The dithering processor 100 may perform a dithering operation for input data DATA1 to generate dither data DATA2. In one example embodiment, the dithering processor 100 may select a target dither table corresponding to a grayscale level of the input data DATA1 among a plurality of dither tables stored in the dither table memory device 200. The dithering processor 100 may perform the dithering operation for the input data DATA1 using the target dither table. Therefore, the dithering processor 100 may perform the dithering operation using the altered dither table in a part of the grayscale regions and may generate the dither data DATA2. In another example embodiment, the dithering processor 100 may select the target dither table corresponding to a position of the input data DATA1 on the display panel 400 among the dither tables. The dithering processor 100 may perform the dithering operation for the input data DATA1 using the target dither table. Therefore, the dithering processor 100 may perform the dithering operation using the altered dither table in a portion of the display panel 400 and may generate the dither data DATA2. Hereinafter, the dithering processor 100 will be described with reference to the FIGS. 2, 9 and 10.

The dither tables may be stored in the dither table memory device 200. In one example embodiment, each of the dither tables may include a plurality of dither patterns. Also, each of the dither patterns may be formed by patterning a plurality of sub-grayscale values to represent a dither grayscale value. Here, the sub-grayscale value refers to a grayscale level for one pixel performing the dithering operation. The dither grayscale value refers to a grayscale level for a dither pixel block that is recognized by a user when the image is displayed by the dithering operation. Hereinafter, a method of representing the dither grayscale value using the dither pattern will be described in detail with reference to the FIGS. 3 and 4.

In one example embodiment, the dither tables may include a normal dither table and an altered dither table. The altered dither table may exclude at least one selected from the sub-grayscale values included in the normal dither table. Thus, the altered dither table may include sub-grayscale values, except one or more sub-grayscale values corresponding to one or more sub-fields in which the display quality is degraded by the RC delay, and the like. To alleviate or remove a stripe pattern occurred by the RC delay, the dithering operation may be performed using the altered dither table. Hereinafter, a method of performing the dithering operation using the normal dither table and the altered dither table will be described in detail with reference to FIGS. 5 and 6.

The display panel driver 300 may drive the display panel 400 based on the dither data DATA2. For example, the display panel driver 300 may include a data driving unit, a scan driving unit, and a timing control unit. The display panel driver 300 may provide a driving signal CNT for displaying an image to the display panel 400. In one example embodiment, the display panel driver 300 may drive the display panel 400 by a digital driving technique that represents a grayscale using a plurality of sub-fields of which time weights are different from each other.

The display panel 400 may include a plurality of pixels. For example, the display panel 400 may be connected to the data driving unit of the display panel driver 300 via a plurality of data lines. The display panel 400 may be connected to the scan driving unit of the display panel driver 300 via a plurality of scan lines. The display panel 400 may include a plurality of pixels arranged at locations corresponding to crossing points of the scan lines and the data lines.

Therefore, the display device 1000 may perform the dither operation using the altered dither table as well as the normal dither table. The altered dither may not include the sub-grayscale values that degrade the display quality. The display device 1000 may alleviate or remove the stripe pattern occurred by the RC delay and may improve the display quality. In addition, the display device 1000 may perform the dithering operation using the altered dither table in a part of the grayscale regions or in a portion of the display panel 400, thereby reducing a dither noise.

Figure 2:
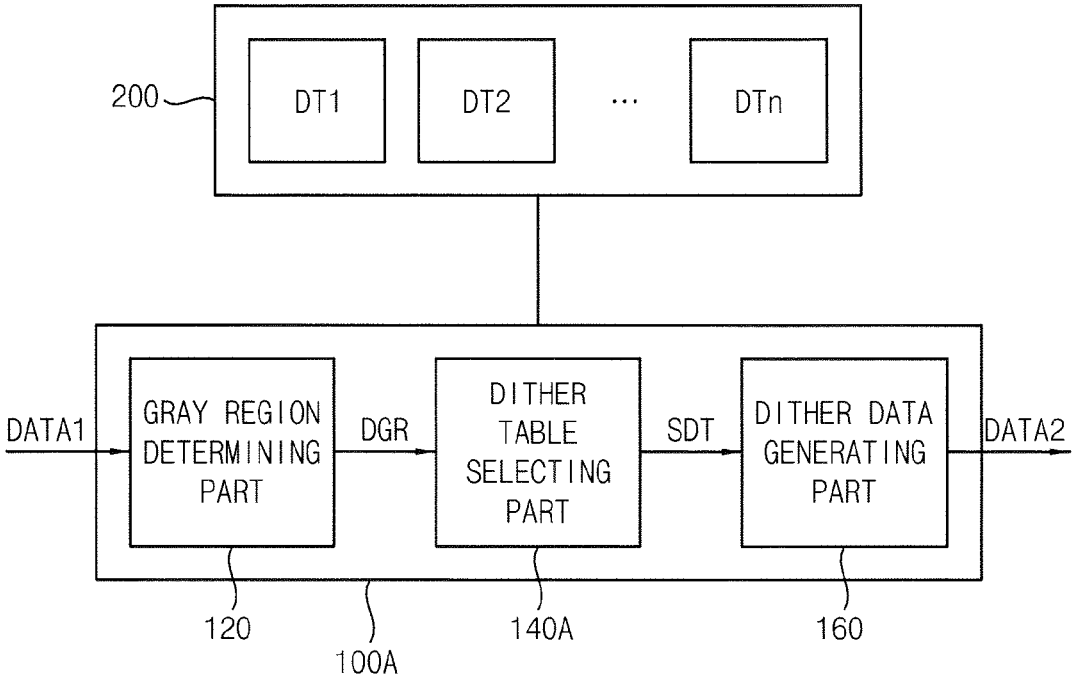
FIG. 2 is a block diagram illustrating one example of a dithering processor included in a display device of FIG. 1.

FIG. 2 is a block diagram illustrating one example of a dithering processor included in a display device of FIG. 1.

Referring to FIG. 2, the dithering processor 100A may include a grayscale region determining part 120, a dither table selecting part 140A, and a dither data generating part 160.

The grayscale region determining part 120 may determine an input data grayscale region DGR corresponding to the grayscale level of the input data DATA1 among a plurality of grayscale regions. The grayscale region determining part 120 may determine what the grayscale regions correspond to the grayscale level of the input data DATA1. For example, the grayscale regions may be divided on the basis of at least one of threshold grayscale levels. The grayscale region determining part 120 may determine the input data grayscale region DGR by comparing the grayscale level of the input data DATA1 with the threshold grayscale levels.

In one example embodiment, the grayscale regions may include a first grayscale region, a second grayscale region, and a third grayscale region. The first grayscale region and the second grayscale region may be divided on the basis of a first threshold grayscale level. The second grayscale region and the third grayscale region may be divided on the basis of a second threshold grayscale level. The second threshold grayscale level may be higher than the first threshold grayscale level. When the grayscale level of the input data DATA1 is lower than the first threshold grayscale level, the grayscale region determining part 120 may determine that the input data grayscale region DGR is included in the first grayscale region. When the grayscale level of the input data DATA1 is higher than the first threshold grayscale level and lower than the second threshold grayscale level, the grayscale region determining part 120 may determine that the input data grayscale region DGR is included in the second grayscale region. When the grayscale level of the input data DATA1 is higher than the second threshold grayscale level, the grayscale region determining part 120 may determine that the input data grayscale region DGR is included in the third grayscale region.

The dither table selecting part 140A may select the target dither table SDT corresponding to the input data grayscale region DGR among the dither tables DT1 through DTn stored in the dither table memory device 200. Each of grayscale regions may have a corresponding dither table. Therefore, the dither table selecting part 140A may select a dither table corresponding to the input data grayscale region DGR as the target dither table SDT.

The dither data generating part 160 may generate the dither data DATA2 by performing the dithering operation for the input data DATA1 using the target dither table SDT. The dither data generating part 160 may generate the dither data DATA2 from the input data DATA1 using the dither patterns included in the target dither table SDT. For example, the dither data generating part 160 may select the dither pattern for the dithering operation from the target dither table SDT using the dither grayscale value corresponding to the input data DATA1. The dither data generating part 160 may perform the dithering operation for the input data DATA1 using the selected dither table and may generate the dither data DATA2.

FIG. 3 is a diagram illustrating an example of sub-grayscale values and sub-fields for representing dither grayscale values.

Referring to FIG. 3, a display panel driver may drive a display panel by a digital driving technique that represents a grayscale using the sub-fields of which time weights are different from each other. Each of sub-grayscale values for representing a dither grayscale value may have a corresponding sub-field value.

For example, the display panel driver may represent the grayscale based on 5 bit sub-fields. The sub-fields may have first through fifth sub-fields of which time weights are sequentially increased. The sub-grayscale value 10 may be represented by setting the first sub-field to 1. The sub-grayscale value 30 may be represented by setting the second sub-field to 1. The sub-grayscale value 40 may be represented by setting the first sub-field and the second sub-field to 1. In one example embodiment, the time weights of the sub-fields may be adjusted based on a distribution of the input data. For example, the number of available sub-fields may be limited in the digital driving technique. Therefore, the time weights of the sub-fields may be adjusted based on the distribution of the input data to efficiently and accurately represent the grayscale.

Figure 4:
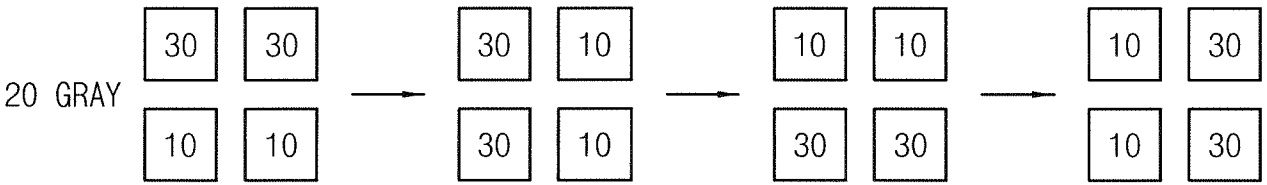
FIG. 4 is a diagram illustrating an example of a dither pattern included in a dither table.

FIG. 4 is a diagram illustrating an example of a dither pattern included in a dither table.

Referring to FIG. 4, the dither pattern may include patterned sub-grayscale values. A dithering operation may be performed using the dither pattern to represent variety of grayscales (i.e., dither grayscales).

For example, the dithering processor may represent the dither grayscale 20 by performing the dithering operation using the dither pattern including the sub-grayscales 10 and 30. A dither pixel block refers to a unit for performing dithering operation. The dither pixel block may include 4 pixels that are adjacent to each other. In order that the dithering processor represents the dither grayscale value 20, the dither pixel block may include two pixels each of which sub-grayscale value is 30 and two pixels each of which sub-grayscale value is 10. The dithering processor may successively switch the sub-grayscale values of 4 pixels included in the dither pixel block. In this case, the dithering processor may adjust a switching speed of the sub-grayscale values not to be recognized by a user. Therefore, the dither grayscale 20 may be recognized by the user. The dithering processor may successively switch the sub-grayscale values, thereby preventing a stain that occurs when deterioration degrees of the pixels are different from each other.

Although the example embodiments of FIG. 4 describe that the dither pixel block may include 4 pixels that are adjacent to each other, the dither pixel block may be implemented by a variety of structures. For example, the dither pixel block may include 9 pixels that are adjacent to each other.

Figure 5:
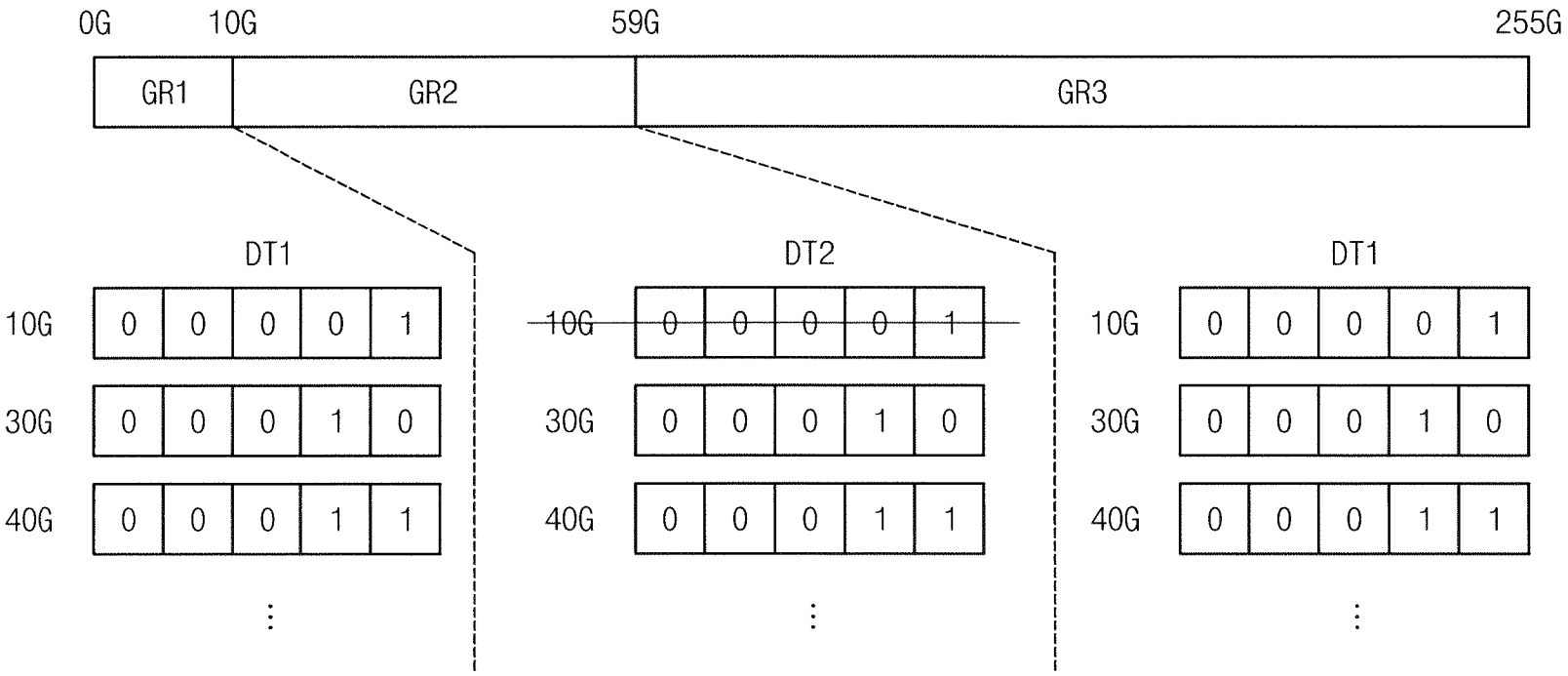
FIG. 5 is a diagram for describing a method of selecting a target dither table corresponding to an input data grayscale region.

FIG. 5 is a diagram for describing a method of selecting a target dither table corresponding to an input data grayscale region.

Referring to FIG. 5, a dithering operation may be performed by changing the dither table in a part of grayscale region.

In one example embodiment, the dither tables may include a normal dither table DT1 and an altered dither table DT2. The altered dither table DT2 may exclude at least one selected from the sub-grayscale values included in the normal dither table DT1. Thus, the altered dither table DT2 may include dither patterns that are formed by patterning sub-grayscale values excluding at least one of the sub-fields. For example, the altered dither table DT2 may not include sub-grayscale values that lead to a degradation of the display quality such as the RC delay, and the like. Therefore, to prevent a stripe pattern occurred by the RC delay, the dithering operation using the altered dither table DT2 may be performed.

In the altered dither table DT2 excluding at least one of the sub-fields, a difference between the sub-grayscale values that are formed one dither pattern may be relatively large in comparison with the normal dither table DT1. If the dither operation is performed using the altered dither table DT2 in all grayscale regions, a dither noise can be recognized by the user owing to the switching of the sub-grayscale values. Therefore, the dither operation is performed using the altered dither table DT2 in a part of the grayscale regions in which the stripe pattern can occur thereby minimizing the dither noise.

In one example embodiment, the grayscale regions may include a first grayscale region GR1, a second grayscale region GR2, and a third grayscale region GR3. Generally, the stripe pattern may be not recognized by the user in a very low grayscale region. Therefore, the dither operation is performed using the normal dither table DT1 in the first grayscale region GR1. On the other hand, the time weights of the sub-grayscale values may be relatively small in a low grayscale region. Effects of the RC delay may be relatively large and the stripe pattern may be recognized by the user in the low grayscale region. Therefore, the dither operation is performed using the altered dither table DT2 in the second grayscale region GR2. Also, the time weights of the sub-grayscale values may be relatively large in a high grayscale region. Effects of the RC delay may be relatively small and the stripe pattern may be not recognized by the user in the high grayscale region. Therefore, the dither operation is performed using the normal dither table DT1 in the third grayscale region GR3. For example, the first grayscale region GR1 and the second grayscale region GR2 may be divided on the basis of a grayscale level 10 (for example, a first threshold grayscale level). The second grayscale region GR2 and the third grayscale region GR3 may be divided on the basis of a grayscale level 59 (for example, a second threshold grayscale level). In one example embodiment, the threshold grayscale levels may be adjusted based on the time weights of the sub-fields. For example, the number of available sub-fields may be limited in a high resolution display device driven by the digital driving technique. The time weights of the sub-fields may be adjusted to efficiently and accurately represent the grayscale. Also, the threshold grayscale levels may be adjusted corresponding to the time weights of the sub-fields.

In one example embodiment, when a grayscale level of the input data is higher than the first threshold grayscale level and the grayscale level of the input data is lower than the second threshold grayscale level, the grayscale region determining part may determine that the input data grayscale region is included in the second grayscale region GR2. The dither table selecting part may select the altered dither table DT2 as the target dither table because the stripe pattern can occur in the second grayscale region GR2. In one example embodiment, the altered dither table DT2 may exclude a minimum sub-grayscale value corresponding to a minimum sub-field of which time weight is smallest among the time weights of the sub-fields included in the normal dither table DT1. Thus, the altered dither table DT2 may exclude sub-grayscale values corresponding to sub-fields of which time weight is relatively small to reduce an effect from the RC delay. For example, the altered dither table DT2 may exclude the sub-grayscale value 10.

In another example embodiment, when a grayscale level of the input data is lower than the first threshold grayscale level or the grayscale level of the input data is higher than the second threshold grayscale level, the grayscale region determining part may determine that the input data grayscale region is included in the first grayscale region GR1 or the third grayscale region GR3, respectively. Because the stripe pattern may not occur in the first grayscale region GR1 and the third grayscale region GR3, the grayscale region determining part may determine the normal dither table DT1 as the target dither table in the first grayscale region GR1 and the third grayscale region GR3.

Therefore, the display device may perform the dithering operation using the altered dither table DT2 excluding the sub-grayscale values that lead to a degradation of the display quality, thereby alleviating or removing the stripe pattern and improving the display quality. In addition, the display device may perform the dithering operation using the altered dither table DT2 in a part of the grayscale regions, thereby reducing the dither noise.

Figure 6:
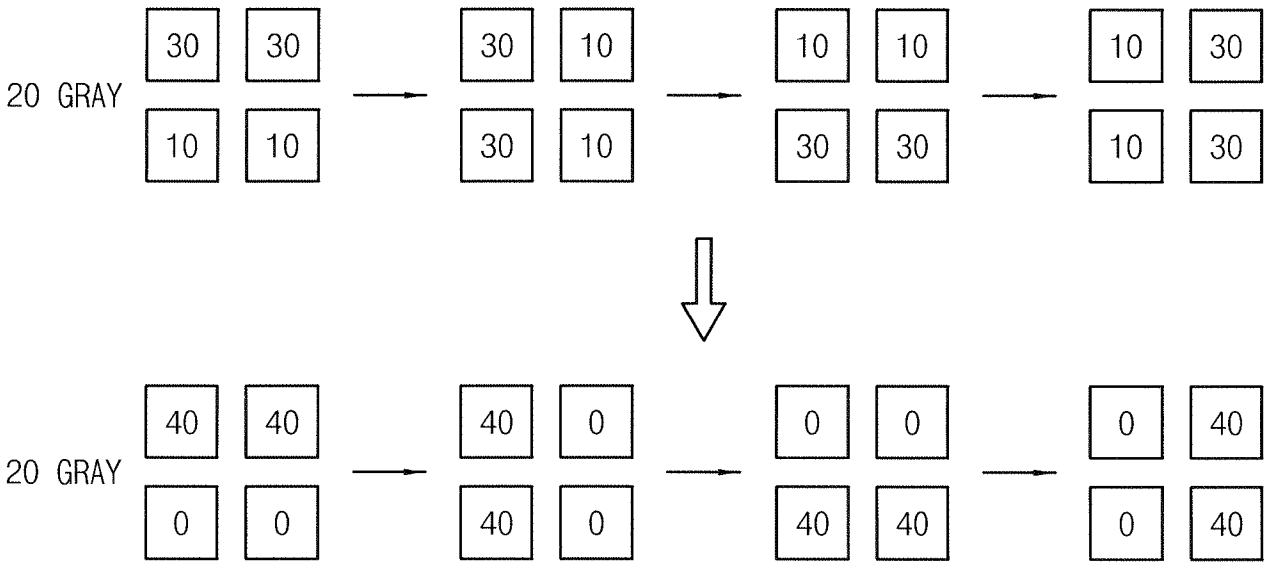
FIG. 6 is a diagram illustrating an example of representing a dither grayscale value using a dither pattern included in a target dither table.

FIG. 6 is a diagram illustrating an example of representing a dither grayscale value using a dither pattern included in a target dither table.

Referring to FIG. 6, a normal dither table and an altered dither table may have different dither patterns from each other for representing the same dither grayscale value.

For example, the normal dither table may include a first dither pattern formed by patterning the sub-scale values 10 and 30 to represent the dither grayscale value 20. The dither pixel block may include 4 pixels that are adjacent to each other. In order that the dithering processor represents the dither grayscale value 20, the dither pixel block may include two pixels each of which sub-grayscale value is 30 and two pixels each of which sub-grayscale value is 10. The dithering processor may successively switch the sub-grayscale values of 4 pixels included in the dither pixel block. Therefore, when the input data grayscale region is included in a grayscale region in which the display quality is not degraded (such as, for example, the first grayscale region or the third grayscale region of FIG. 5), the dithering operation is performed using the normal dither table formed by patterning sub-grayscale value 10 and 30 to represent the dither grayscale value 20.

On the other hand, the altered dither table may include a second dither pattern formed by patterning the sub-scale values 0 and 40 to represent the dither grayscale value 20. The dither pixel block may include 4 pixels that are adjacent to each other. In order that the dithering processor represents the dither grayscale value 20, the dither pixel block may include two pixels each of which sub-grayscale value is 40 and two pixels each of which sub-grayscale value is 0. The dithering processor may successively switch the sub-grayscale values of 4 pixels included in the dither pixel block. Therefore, when the input data grayscale region is included in a grayscale region in which the display quality is degraded (such as, for example, the second grayscale region of FIG.

5), the dithering operation is performed using the altered dither table formed by patterning sub-grayscale value 0 and 40 to represent the dither grayscale value 20.

Figure 7:
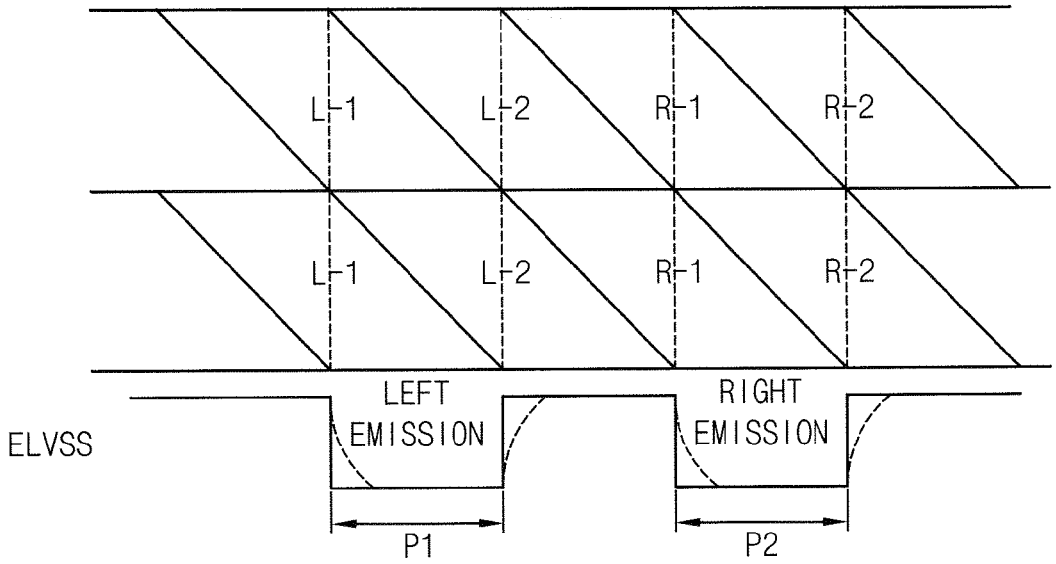
FIGS. 7 and 8 are diagrams for describing stripe patterns occurred by a RC delay.
Figure 8:
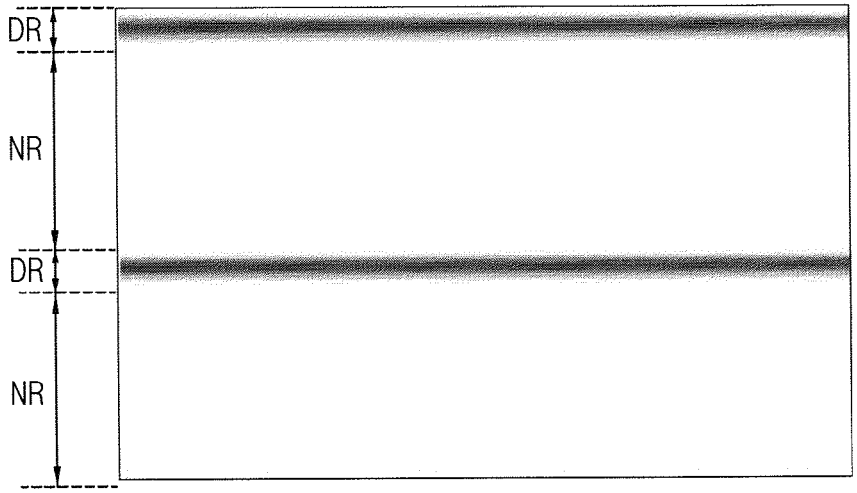

FIGS. 7 and 8 are diagrams for describing stripe patterns occurred by a RC delay.

Referring to FIGS. 7 and 8, the stripe patterns may be occurred by a RC delay a portion of the display panel.

As shown in FIG. 7, a three dimensional (3D) organic light emitting display device may be driven by a progressive emission technique. The 3D organic light emitting display device may adjust a cathode voltage ELVSS of an organic light emitting diode to display a left-eye image and a right eye image, respectively. Thus, the cathode voltage ELVSS may be a low level in a first period P1 in which the left-eye image is displayed and a second period P2 in which the right-eye image is displayed, thereby displaying the left-eye image and the right-eye image. On the other hand, the cathode voltage ELVSS may be a high level in a period other than the first period P1 and the second period P2, thereby restricting an emission of the light by the organic light emitting diode. When the cathode voltage ELVSS is changed from the high level to low level or the cathode voltage ELVSS is changed from the low level to high level, the organic light emitting diode may be affected by the RC delay. Thus, the first left-eye image data L-1 and the second left-eye image data L-2 may not be normally displayed in the first period P1 owing to the RC delay. The first right-eye image data R-1 and the second right-eye image data R-2 may not be normally displayed in the second period P2 owing to the RC delay. Especially, when the sub-field of which time weight is relatively small is outputted, the stripe pattern can be recognized by the user.

As shown in FIG. 8, in the 3D organic light emitting display device, the stripe patterns may occur in a certain portion of the display panel. For example, when the cathode voltage ELVSS is changed from the high level to low level, the RC delay may occur. Therefore, in the display device driven by the progressive emission technique, the stripe pattern may be recognized by the user in the portion of the display panel corresponding to a starting point of the frame period.

In one example embodiment, a delay region DR in which the RC delay occur and a non-delay region NR in which the RC delay does not occur may be determined based on a position of the input data on the display panel. The display device may perform the dithering operation using the normal dither table in the non-delay region NR. Also, the display device may perform the dithering operation using the altered dither table in the delay region DR to reduce the dither noise.

Figure 9:
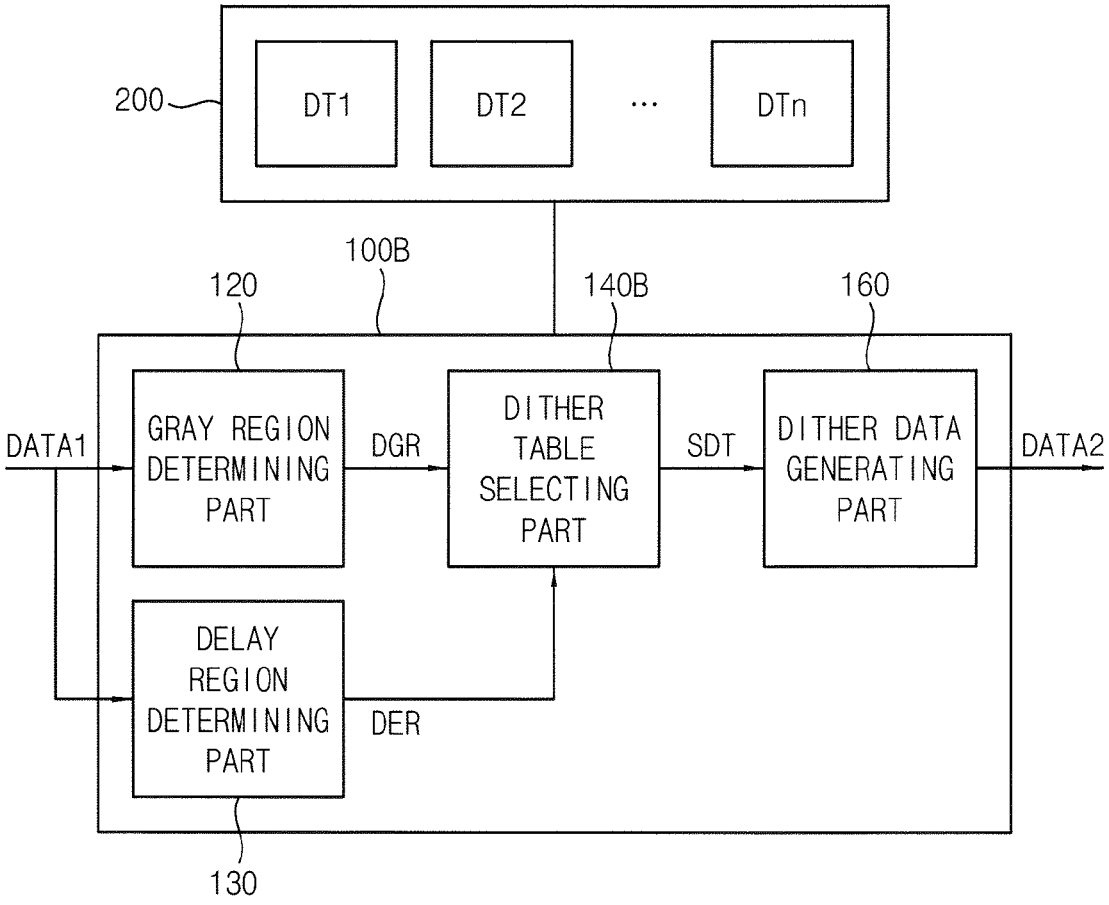
FIG. 9 is a block diagram illustrating another example of a dithering processor included in a display device of FIG. 1.

FIG. 9 is a block diagram illustrating another example of a dithering processor included in a display device of FIG. 1.

Referring to FIG. 9, the dithering processor 100B may include a grayscale region determining part 120, a delay region determining part 130, a dither table selecting part 140B, and a dither data generating part 160. The dithering processor 100B illustrated in FIG. 9 is substantially the dithering processor illustrated in FIG. 2, except that the delay region determining part 130 is added. Therefore, the same reference numerals will be used to refer to the same or like parts as those described in FIG. 2, and any repetitive explanation concerning the above elements will be omitted.

The grayscale region determining part 120 may determine an input data grayscale region DGR corresponding to the grayscale level of the input data DATA1 among a plurality of grayscale regions.

The delay region determining part 130 may determine a delay region in which a RC delay occurs and a non-delay region in which the RC delay does not occur, based on a position of the input data DATA1 on the display panel. Thus, the delay region determining part 130 may confirm that the input data DATA1 corresponds the delay region or the non-delay region, and may determine an input data delay region DER. The stripe patterns may occur in a certain portion of the display panel. When the dithering operation is performed using the altered dither table to alleviate or remove the stripe pattern by the RC delay, the dither noise can be recognized by the user. Therefore, the delay region and the non-delay region may be determined to apply the altered dither table in the delay region and to apply the normal dither table in the non-delay region.

The dither table selecting part 140B may select the target dither table SDT corresponding to the input data grayscale region DGR among the dither tables DT1 through DTn stored in the dither table memory device 200. In addition, when the input data DATA1 corresponds to the non-delay region, the dither table selecting part 140B may select a normal dither table as the target dither table SDT. Thus, to apply the altered dither table in a part of the grayscale regions or in a portion of the display panel, the dither table selecting part 140B may select the target dither table SDT based on the input data grayscale region DGR and the input data delay region DER. Therefore, the display device may apply the altered dither table to the input data DATA1 in which the stripe pattern can be occurred by the RC delay, thereby reducing the dither noise.

The dither data generating part 160 may generate the dither data DATA2 by performing the dithering operation for the input data DATA1 using the target dither table SDT.

Figure 10:
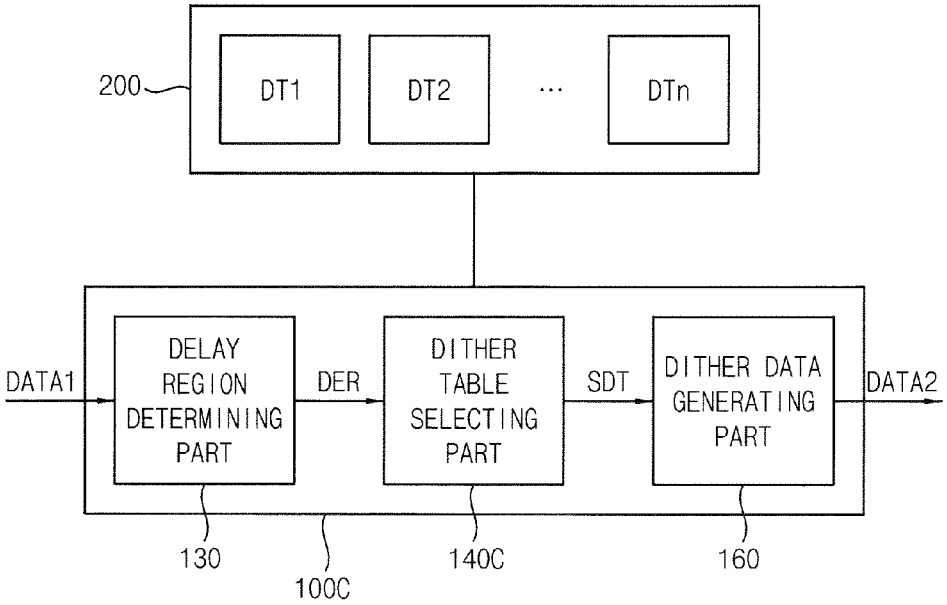
FIG. 10 is a block diagram illustrating still another example of a dithering processor included in a display device of FIG. 1.

FIG. 10 is a block diagram illustrating still another example of a dithering processor included in a display device of FIG. 1.

Referring to FIG. 10, the dithering processor 100C may include a delay region determining part 130, a dither table selecting part 140C, and a dither data generating part 160. The dithering processor 100C illustrated in FIG. 10 is substantially the dithering processor illustrated in FIG. 2, except that the grayscale region determining part 120 is deleted and the delay region determining part 130 is added. Therefore, the same reference numerals will be used to refer to the same or like parts as those described in FIG. 2, and any repetitive explanation concerning the above elements will be omitted.

The delay region determining part 130 may determine a delay region in which a RC delay occurs and a non-delay region in which the RC delay does not occur, based on a position of the input data DATA1 on the display panel. Thus, the delay region determining part 130 may confirm that the input data DATA1 corresponds to the delay region or to the non-delay region and may determine an input data delay region DER. Since the delay region determining part 130 is described above, duplicated descriptions will be omitted.

The dither table selecting part 140C may select the target dither table SDT corresponding to the input data delay region DER. When the input data DATA1 corresponds to the non-delay region, the dither table selecting part 140C may select a normal dither table as the target dither table SDT. When the input data DATA1 corresponds to the delay region, the dither table selecting part 140C may select an altered dither table as the target dither table SDT. When the target dither table SDT is selected based on the input data grayscale region DGR, the display device may have a relatively high load. Therefore, the dither table selecting part 140C may select the target dither table SDT based on a position of the input data DATA1 on the display panel. The display device may perform a dithering operation using the altered dither table in a region of the display panel in which the stripe pattern can be occurred by the RC delay, thereby reducing the dither noise.

The dither data generating part 160 may generate the dither data DATA2 by performing the dithering operation for the input data DATA1 using the target dither table SDT.

Although the example embodiments describe that the display device is an organic light emitting display device, a kind of the display device is not limited thereto.

The present inventive concepts may be applied to an electronic device having the display device. For example, the present inventive concepts may be applied to a cellular phone, a smart phone, a smart pad, a personal digital assistant (PDA), and the like.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concepts. Accordingly, all such modifications are intended to be included within the scope of the present inventive concepts as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device comprising:

a display panel including a plurality of pixels;

a dither table memory device, in which a plurality of dither tables are stored, wherein each of the dither tables includes a plurality of dither patterns, wherein each of the dither patterns is formed by patterning a plurality of sub-grayscale values to represent a dither grayscale value, wherein the dither tables includes a normal dither table and an altered dither table, and wherein the altered dither table excludes at least one of the sub-grayscale values included in the normal dither table;

a dithering processor configured to:

select a target dither table corresponding to a grayscale level of input data from among the plurality of dither tables, and to perform a dithering operation on the input data using the target dither table to generate dither data;

determine an input data grayscale region corresponding to the grayscale level of the input data among a plurality of grayscale regions, the grayscale regions divided based on at least one threshold grayscale level;

select the target dither table corresponding to the input data grayscale region from among the plurality of dither tables; and generate the dither data by performing the dithering operation on the input data using the target dither table; and a display panel driver configured to drive the display panel based on the generated dither data and by a digital driving technique that represents a grayscale using a plurality of sub-fields for which time weights are different from each other, wherein the at least one threshold grayscale level is adjusted based on the time weights of the sub-fields.

2. The display device of claim 1, wherein the dithering processor is further configured to:

determine a delay region in which a resistor-capacitor (RC) delay occurs and a non-delay region in which the RC delay does not occur, based on a position of the input data on the display panel.

3. The display device of claim 2, wherein the dithering processor is configured to select the normal dither table as the target dither table when the input data corresponds to the non-delay region.

4. The display device of claim 1, wherein the altered dither table excludes a minimum sub-grayscale value corresponding to a minimum sub-field of which time weight is smallest among the time weights of the sub-fields.

5. The display device of claim 1, wherein the time weights of the sub-fields are adjusted based on a distribution of the input data.

6. A display device comprising:

a display panel including a plurality of pixels;

a dither table memory device, in which a plurality of dither tables are stored, wherein each of the dither tables includes a plurality of dither patterns, wherein each of the dither patterns is formed by patterning a plurality of sub-grayscale values to represent a dither grayscale value;

a dithering processor configured to:

select a target dither table corresponding to a grayscale level of input data from among the plurality of dither tables, and to perform a dithering operation on the input data using the target dither table to generate dither data;

determine an input data grayscale region corresponding to the grayscale level of the input data among a plurality of grayscale regions, the grayscale regions divided based on at least one threshold grayscale level;

select the target dither table corresponding to the input data grayscale region from among the plurality of dither tables; and generate the dither data by performing the dithering operation on the input data using the target dither table; and a display panel driver configured to drive the display panel based on the generated dither data, wherein the dither tables includes a normal dither table and an altered dither table, wherein the altered dither table excludes at least one of the sub-grayscale values included in the normal dither table, wherein the grayscale regions includes a first grayscale region, a second grayscale region, and a third grayscale region, wherein the first grayscale region and the second grayscale region are divided based on the basis of a first threshold grayscale level, wherein the second grayscale region and the third grayscale region are divided based on the basis of a second threshold grayscale level, and wherein the second threshold grayscale level is higher than the first threshold grayscale level.

7. The display device of claim 6, wherein the dithering processor is configured to select the normal dither table as the target dither table when the input data grayscale region is included in the first grayscale region or the third grayscale region.

8. The display device of claim 6, wherein the dithering processor is configured to select the altered dither table as the target dither table when the input data grayscale region is included in the second grayscale region.

9. A display device comprising:

a display panel including a plurality of pixels;

a dither table memory device, in which a plurality of dither tables are stored, wherein each of the dither tables includes a plurality of dither patterns, and wherein each of the dither patterns is formed by patterning a plurality of sub-grayscale values to represent a dither grayscale value;

a dithering processor configured to:

select a target dither table corresponding to a position of input data on the display panel from among the plurality of dither tables, and to perform a dithering operation on the input data using the target dither table to generate dither data;

determine a delay region in which a resistor-capacitor (RC) delay occurs and a non-delay region in which the RC delay does not occur, based on the position of the input data on the display panel;

select the normal dither table as the target dither table when the input data corresponds to the non-delay region, and select the altered dither table as the target dither table when the input data corresponds to the delay region; and generate the dither data by performing the dithering operation on the input data using the target dither table; and a display panel driver configured to drive the display panel based on the generated dither data.

10. The display device of claim 9, wherein the dither tables includes a normal dither table and an altered dither table, and wherein the altered dither table excludes at least one of the sub-grayscale values included in the normal dither table.

11. The display device of claim 10, wherein the display panel driver drives the display panel by a digital driving technique that represents a grayscale using a plurality of sub-fields for which time weights are different from each other.

12. The display device of claim 11, wherein the altered dither table excludes a minimum sub-grayscale value corresponding to a minimum sub-field of which time weight is smallest among the time weights of the sub-fields.

13. The display device of claim 11, wherein the time weights of the sub-fields are adjusted based on a distribution of the input data.

* * * * *